US011344932B2

(12) United States Patent
He

(10) Patent No.: US 11,344,932 B2
(45) Date of Patent: May 31, 2022

(54) DEVICE AND SYSTEM FOR CLEANING GLASS SUBSTRATES WITH DIFFERENT DIMENSIONS

(71) Applicant: HKC Corporation Limited, Guangdong (CN)

(72) Inventor: Huailiang He, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 129 days.

(21) Appl. No.: 16/645,790

(22) PCT Filed: Dec. 20, 2017

(86) PCT No.: PCT/CN2017/117331

§ 371 (c)(1),
(2) Date: Mar. 10, 2020

(87) PCT Pub. No.: WO2019/047420

PCT Pub. Date: Mar. 14, 2019

(65) Prior Publication Data

US 2020/0269290 A1 Aug. 27, 2020

(30) Foreign Application Priority Data

Sep. 11, 2017 (CN) ..... 201710813561.7

(51) Int. Cl.
*B08B 11/04* (2006.01)
*B08B 13/00* (2006.01)
(Continued)

(52) U.S. Cl.
CPC ..... *B08B 11/04* (2013.01); *B08B 1/001* (2013.01); *B08B 1/02* (2013.01); *B08B 13/00* (2013.01)

(58) Field of Classification Search
CPC ..... B08B 11/04; B08B 13/00; B08B 3/022; B08B 1/001; B08B 1/02
See application file for complete search history.

(56) References Cited

U.S. PATENT DOCUMENTS 3,944,461 A * 3/1976 Ogron ..... B32B 17/10935 156/538
5,246,477 A * 9/1993 Kramer ..... C03B 23/0254 65/107

(Continued)

FOREIGN PATENT DOCUMENTS

CN 1593793 A 3/2005
CN 202145461 U 2/2012

(Continued)

OTHER PUBLICATIONS

Machine translation of JP2000024602A (Year: 2000).*
International Search Report of PCT Patent Application No. PCT/CN2017/117331 dated Jun. 7, 2018.

*Primary Examiner* — Douglas Lee

(57) ABSTRACT

The present disclosure provides a device and a system for cleaning glass substrates with different dimensions. The device includes a rack (1); conveying rollers (2) rotatably disposed on the rack (1); a limiting assembly (4) including a first roller (41) and a second roller (42), the first roller (41) being fixed on a first connecting rod (43), and the second roller (42) being fixed on a second connecting rod (44), and the first connecting rod (43) and the second connecting rod (44) being movable along an axial direction of the conveying roller (2); a driving device (5) for driving the conveying rollers (2), the first roller (41) and the second roller (42) to rotate; a cleaning assembly (6) including an upper cleaning box (61) and a lower cleaning box (62), and the upper cleaning box (61) and the lower cleaning box (62) being both provided with nozzles.

19 Claims, 1 Drawing Sheet

(51) Int. Cl.
*B08B 1/00* (2006.01)
*B08B 1/02* (2006.01)

(56) References Cited

U.S. PATENT DOCUMENTS

| | | | | |
|---|---|---|---|---|
| 9,165,809 | B2 * | 10/2015 | Bae | B65G 39/09 |
| 2019/0035661 | A1 * | 1/2019 | Nakatani | H01L 21/67051 |

FOREIGN PATENT DOCUMENTS

| | | | | |
|---|---|---|---|---|
| CN | 103084366 | A | | 5/2013 |
| CN | 104014572 | A | | 9/2014 |
| CN | 205128553 | U | | 4/2016 |
| CN | 206535842 | U | | 10/2017 |
| CN | 207188322 | U | | 4/2018 |
| JP | 2000024602 | A | * | 1/2000 |
| JP | 2000024602 | A | | 1/2000 |
| JP | 2004258368 | A | | 9/2004 |
| JP | 2005028327 | A | | 2/2005 |
| JP | 2007083140 | A | | 4/2007 |
| KR | 20130092315 | A | | 8/2013 |
| TW | 200926915 | A | | 6/2009 |

* cited by examiner

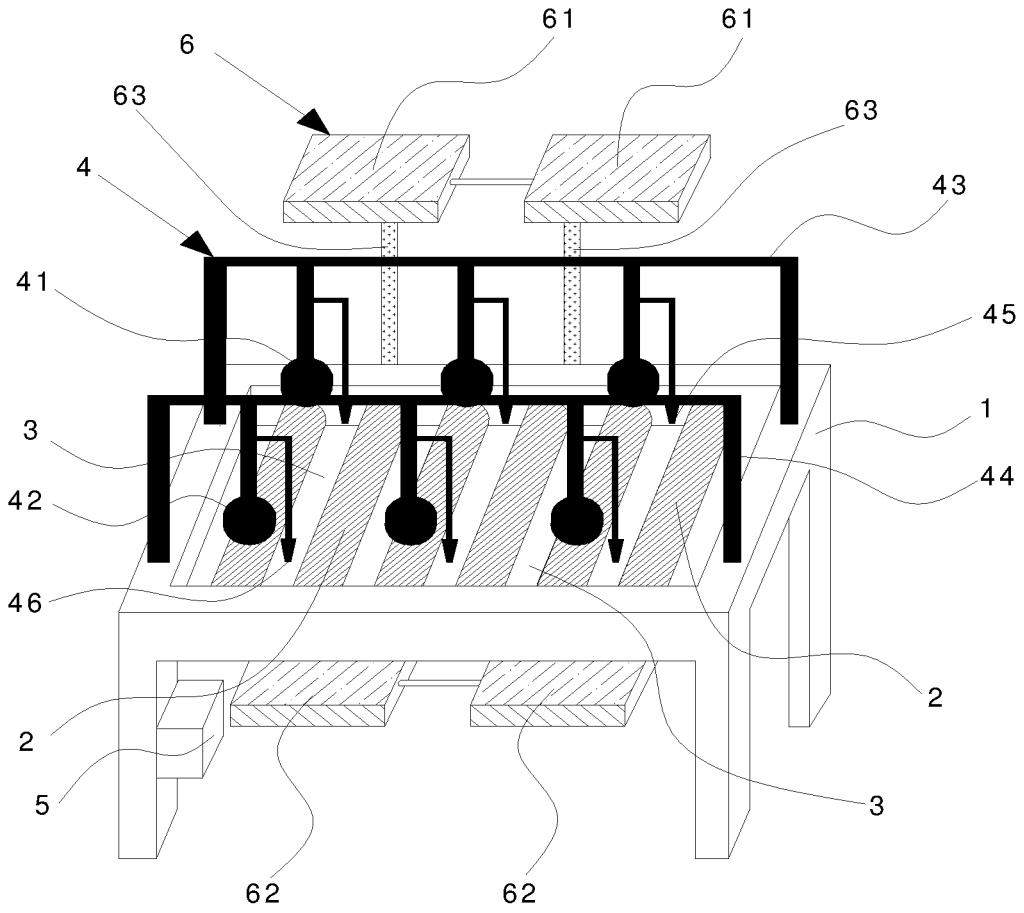
6
61
61
63
63
4
43
41
45
1
3
44
42
46
2
2
5
3
62
62

DEVICE AND SYSTEM FOR CLEANING GLASS SUBSTRATES WITH DIFFERENT DIMENSIONS

FIELD

The present application relates to the field of electronic technology, in particular, to a device for cleaning glass substrates with different dimensions and system.

BACKGROUND

The glass substrate is one of the key basic materials of the flat panel display manufacturing, which is especially the main structural components of the liquid crystal display. The glass substrate needs to be coated in the process of being processed into the liquid crystal display during which the sputter coating is generally adopted. Therefore, in order to ensure the coating effect, the glass substrate must be thoroughly cleaned before coating.

At present, the device for surface cleaning of the glass substrate before the manufacturing process is mostly a single rack, which can only clean the size of a single glass substrate in correspondence, that is, multiple sizes cannot be corresponded. In the event of customer or market changes, certain modifications must be made to match the specific glass substrate size, which not only results in inefficient work, but also leads to high production costs and the diverse needs of customers cannot be met.

SUMMARY

Embodiments of the present application provide a device for cleaning glass substrates with different dimensions and system, which is simple in structure and convenient to use, can not only improve work efficiency, reduce production cost, but also meet various needs of customers.

On one hand, embodiments of the present application provide a device for cleaning glass substrates with different dimensions, the device for cleaning glass substrates with different dimensions includes:

a rack;

conveying rollers rotatably disposed on the rack side by side, and at least one pair of adjacent conveying rollers are disposed with a gap;

a limiting assembly including a first roller and a second roller disposed oppositely, the first roller is fixed on a first connecting rod, and the second roller is fixed on a second connecting rod, and two ends of the first connecting rod are respectively fixed on two opposite sides of the rack, two ends of the second connecting rod are respectively fixed on two opposite sides of the rack, and the first connecting rod and the second connecting rod are movable along an axial direction of the conveying roller, to enable the glass substrate to position in a space defined by the first roller, the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly, disposed on the rack and configured to clean the glass substrates.

On the other hand, embodiments of the present application further provide a device for cleaning glass substrates with different dimensions, the device for cleaning glass substrates with different dimensions includes:

a rack;

conveying rollers, rotatably disposed on the rack side by side, at least one pair of adjacent conveying rollers being disposed with a gap;

a limiting assembly, including a first roller and a second roller disposed oppositely, the first roller being fixed on a first connecting rod, and the second roller being fixed on a second connecting rod, and two ends of the first connecting rod being respectively fixed on two opposite sides of the rack, two ends of the second connecting rod being respectively fixed on two opposite sides of the rack, and the first connecting rod and the second connecting rod being movable along an axial direction of the conveying roller, to enable the glass substrate to position in a space defined by the first roller, the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly, disposed on the rack and configured to clean the glass substrates;

the limiting assembly further includes a first limit wheel located on the first connecting rod and driven by a driving device and a second limit wheel located on the second connecting rod, the first limit wheel and the second limit wheel being both located in any one of the gaps, the glass substrate being located between the first limit wheel and the second limit wheel, and a tangential direction of a rotating direction of the first limit wheel, and a tangential direction of a rotating direction of the second limit wheel are same as a moving direction of the glass substrate;

the cleaning assembly includes an upper cleaning box located above the conveying roller and fixed to the rack by a fixing rod and a lower cleaning box located below the conveying roller and fixed to the rack by another fixing rod, the upper cleaning box including nozzles, and the lower cleaning box including nozzles.

On the other hand, embodiments of the present application further provide a system for cleaning glass substrates with different dimensions, including:

a control unit; and a device for cleaning glass substrates with different dimensions, including:

a rack;

conveying rollers rotatably disposed on the rack side by side, wherein at least one pair of adjacent conveying rollers are disposed with a gap;

a limiting assembly, including a first roller and a second roller disposed oppositely, the first roller being fixed on a first connecting rod, and the second roller being fixed on a second connecting rod, and two ends of the first connecting rod being respectively fixed on two opposite sides of the rack, two ends of the second connecting rod being respectively fixed on two opposite sides of the rack, and the first connecting rod and the second connecting rod being movable along an axial direction of the conveying roller, to enable the glass substrate to position in a space defined by the first roller, the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly disposed on the rack and configured to clean the glass substrates;

wherein the control unit is configured to control operating states of the driving device and the cleaning assembly.

Embodiments of the present application are simple in structure and convenient to use, can not only improve work efficiency, reduce production cost, but also improve user experience. In particular, the first connecting rod and the second connecting rod can both move along the axial direction of the conveying roller, so that the distance between the first connecting rod and the second connecting rod is adjustable, thereby enabling adaptation and cleaning of the glass substrates of different sizes. At the same time, the arrangement of the first limit wheel and the second limit wheel can also ensure that the glass substrate can keep moving in a certain direction when it is cleaned during conveying.

BRIEF DESCRIPTION OF THE DRAWINGS

In order to be more clearly illustrating the technical solutions of embodiments of the present disclosure, the drawings which are required to be used in the description of the embodiments will be briefly described below. It is obvious that the drawings described below are some embodiments of the present disclosure. It will be apparent to one of ordinary skill in the art that other drawings may be obtained based on the accompanying drawings without inventive effort.

FIG. 1 is a structural view of a device for cleaning glass substrates with different dimensions of the present application.

DETAILED DESCRIPTION OF THE EMBODIMENTS

The technical solutions in the embodiments of the present application will be clearly and completely described hereafter in connection with the embodiments of the present application. It is apparent that the described embodiments are a part of the embodiments of the present application, but not the whole. Based on the embodiments of the present application, all the other embodiments obtained by that of ordinary skill in the art without inventive effort are within the scope of the present application.

It is understood that the terms "comprises" and "includes" when used in the specification and the appended claims indicates the presence of features, entireties, steps, operations, elements, and/or components described while the presence or addition of one or more other features, entireties, steps, operations, elements, components and/or combinations thereof are not excluded.

It is also understood that the terms used herein is for the purpose of describing particular embodiments and is not intended to be limiting the present application. As used in the specification and the appended claims, the singular forms of "a," "one" and "the" are intended to include the plural forms, unless the context clearly indicates otherwise. It is further understood that the term "and/or" used in the specification and the appended claims refers to any combination of one or more of the associated listed items and all possible combinations, and includes such combinations.

As shown in FIG. 1, an embodiment of the present application provides a device for cleaning glass substrates with different dimensions, which includes a rack 1, conveying rollers 2, a limiting assembly 4, a driving device 5, and a cleaning assembly 6.

The conveying rollers 2 are rotatably disposed on the rack 1 side by side, and at least one pair of adjacent conveying rollers are provided with a gap 3.

The limiting assembly 4 includes a first roller 41 and a second roller 42 disposed oppositely, the first roller 41 is fixed on a first connecting rod 43, and the second roller 42 is fixed on a second connecting rod 44, and two ends of the first connecting rod 43 are respectively fixed on two opposite sides of the rack 1, two ends of the second connecting rod 44 are respectively fixed on two opposite sides of the rack 1, and the first connecting rod 43 and the second connecting rod 44 are movable along an axial direction of the conveying roller 2, so the glass substrate is in a space defined by the first roller 41 and the second roller 42 and the conveying roller 2.

The driving device 5 configured to drive the conveying roller 2 and the first roller 41 and the second roller 42 to rotate, so that the glass substrate moves in a tangential direction of a rotating direction of the conveying roller 2, rotating directions of the first roller 41 and the second roller 42 rotate are opposite to the rotating direction of the conveying roller 2.

The cleaning assembly 6 is disposed on the rack 1 and configured to clean the glass substrates.

Specifically, the rack 1 may be any structure capable of carrying the conveying roller 2 and the other components described above. The number of the conveying rollers 2 may be two, three or more. Of course, the number of conveying rollers can be appropriately set according to actual conditions. The gap 3 is provided to facilitate the corresponding cleaning of the lower surface of the glass substrate to be cleaned on the conveying roller in the cleaning assembly.

At the same time, the first roller 41 and the second roller 42 are disposed on two opposite sides of the rack 1 respectively, so that the glass substrate can receive a more uniform force, and can cooperate with the rotation of the conveying roller to jointly push the glass substrate to move, so that the upper and lower surfaces of the glass substrate are cleaned by the cleaning assembly simultaneously.

In addition, the first roller 41 is fixed on the first connecting rod 43, the second roller 42 is fixed on the second connecting rod 44, and the first connecting rod 43 and the second connecting rod 44 may move along the axial direction of the conveying roller 2, so that the distance between the first connecting rod 43 and the second connecting rod 44 can be adjusted, thereby adjusting the distance between the first roller 41 and the second roller 42 accordingly. That is, the distance between the first connecting rod 43 and the second connecting rod 44 can be adjusted according to the size of the glass substrate, so that the glass substrate can be more steady in moving in the direction in which the conveying roller rotates under the action of the first roller 41 and the second roller 42 and achieve the purpose of cleaning.

Further, the driving device 5 can drive the conveying roller 2, the first roller 41, and the second roller 42 to rotate correspondingly.

Therefore, embodiments of the present application are simple in structure and convenient to use, can not only improve work efficiency, reduce production cost, but also improve user experience. In particular, the first connecting rod and the second connecting rod can both move along the axial direction of the conveying roller, so that the distance between the first connecting rod and the second connecting rod is adjustable, thereby enabling adaptation and cleaning of the glass substrates of different sizes.

In some embodiments, the limiting assembly 4 further includes a first limit wheel 45 located on the first connecting rod 43 and driven by the driving device 5 and a second limit wheel 46 located on the second connecting rod 44. Each gap 3 is configured to receive the first limit wheel 45 and the second limit wheel 46, and the glass substrate is located between the first limit wheel 45 and the second limit wheel 46, the tangential direction of the rotation of the first limit wheel 45 and that of the second limit wheel 46 are the same as a moving direction of the glass substrate.

Specifically, the first limit wheel 45 and the second limit wheel 46 can ensure that the glass substrate can keep moving in a certain direction when it is conveyed and cleaned, for avoiding the deviation of the conveying direction of the glass substrate. It is more conducive to the entire conveying, reducing needless bothers and improving the efficiency of cleaning. Without doubt, the first limit wheel 45 and the second limit wheel 46 can also be directly and movably fixed to the rack 1 according to actual conditions. And the distance between the first limit wheel 45 and the second limit wheel 46 can also be adjusted according to the size of the glass substrate, that is, to ensure the first limit wheel 45 is located on one side of the glass substrate while the second limit wheel 46 is located on the other side of the glass substrate, for timely adjusting the direction of the glass substrates of different sizes during the conveying process, so that the glass substrates may be cleaned well without being damaged.

In some embodiments, the first limit wheel 45 and the second limit wheel 46 are truncated cone-shaped limiting wheels whose cross-sectional radii gradually decrease. Without doubt, the shapes of the first limit wheel and the second limit wheel can be selected correspondingly according to the actual situation as long as the limiting condition can be met, and are not limited to the shapes expressed by the above embodiments.

In some embodiments, one gap 3 is disposed between each pair of conveying roller 2. The gap 3 is arranged to enable the cleaning assembly 6 to clean the lower surface of the glass substrate. A gap 3 is provided between each pair of conveying roller 2 to enable better cleaning of the lower surface of the glass substrate.

In some embodiments, each gap is configured to receive at least one first limit wheel 45 and at least one second limit wheel 46. Each gap is also configured to receive at least one limiting wheel and at least one second limit wheel 46, which can better limit the glass substrate during the conveying process and prevent the glass substrate from deviating from the original movement position.

In addition, in some embodiments, the gap 3 ranges from 5 to 20 mm That is to say, the size of the gap 3 may be at least 5 mm, or may be 10 mm or 15 mm, or may be 20 mm Without doubt, the size of the gap 3 may be specifically defined according to actual conditions.

Meanwhile, in some embodiments, the limiting assembly 4 includes three pairs of first roller 41 and second roller 42, the first rollers 41 are evenly spaced, the second rollers 42 are evenly spaced, and the first roller 41 face the second rollers 42. Each pair of first roller 41 corresponds to each corresponding pair of second roller 42. For the limiting assembly, the number of the first rollers and the second rollers and the positional relationship of the first rollers and the second rollers may be set to balance the external force applied to the glass substrates during the rotation, for conveying the glass substrates smoothly. Without doubt, the limiting component 4 can include four pairs of first roller 41 and second roller 42, the first rollers 41 are evenly spaced, the second rollers 42 are evenly spaced, and the first rollers 41 face the second rollers 42. Of course, it is also possible to set different numbers of first rollers 41 and second rollers 42 within the range allowed by the rack, the first rollers 41 are evenly spaced, the second rollers 42 are evenly spaced, and the first rollers 41 are opposite to second rollers 42. The more the first and second rollers 41, 42 that are evenly spaced in opposite directions, the better the glass substrates may be conveyed.

In some embodiments, a first pair of first roller 41 and second roller 42 that are evenly spaced in opposite directions are disposed at one end of the rack, and a second pair of the first roller 41 and second roller 42 that are evenly spaced in opposite directions are disposed at an intermediate position of the rack, and a third pair of oppositely disposed first roller 41 and second roller 42 that are evenly spaced in opposite directions are disposed at the other end of the rack. The positional relationships between each of the first rollers 41 and each of the second rollers 42 may be set to convey of the glass substrates better.

In some embodiments, the cleaning assembly 6 includes an upper cleaning box 61 located above the conveying rollers 2 and a lower cleaning box 62 located below the conveying rollers 2, the upper cleaning box 61 and the lower cleaning box 62 are fixed on the rack by fixing rods 63, and the upper cleaning box 61 and the lower cleaning box 62 are both provided with nozzles. The arrangement of the upper and lower cleaning boxes may enable a better cleaning of the upper and lower surfaces of the glass substrates. The positional relationships and the numbers of the upper cleaning boxes and the lower cleaning boxes can be arranged according to actual conditions.

In some embodiments, the number of the upper cleaning boxes 61 is two, the two upper cleaning boxes 61 are evenly and directly arranged above the conveying rollers 2. The number of the upper cleaning boxes 61 is two, the two upper cleaning boxes 61 may effectively clean the upper surfaces of the glass substrates. Of course, the number of the upper cleaning boxes can be reasonably arranged according to actual conditions.

In some embodiments, the number of the lower cleaning boxes 62 is two, the two lower cleaning boxes 62 are evenly and directly distributed above the conveying rollers 2. The number of the lower cleaning boxes 62 is two, the two lower cleaning boxes 62 may effectively clean the upper surface of the glass substrates. Of course, the number of the lower cleaning boxes can be reasonably arranged according to actual conditions.

The specific working process of the device for cleaning glass substrates with different dimensions is as follows: placing the glass substrate on the conveying rollers 2 of the rack 1, the upper surface of the glass substrate is in contact with both the first first roller 41 and the second roller 42; switching on the driving device 5 to drive the conveying rollers 2, the first the first roller 41 and the second roller 42 to rotate respectively, the rotation speeds of the conveying rollers are normally the same as the rotation speeds of the first roller and the second roller, thereby smoothly conveying the glass substrate from one end of the conveying roller to the other end. During the conveying process, both the upper cleaning box and the lower cleaning box may be configured to clean the glass substrate, so that the upper and lower surfaces of the glass substrate can be effectively cleaned to achieve a wet cleaning of the glass substrate. In addition, the first limit wheel 45 and the second limit wheel 46 are also rotated under an action of the driving device 5, thereby effectively limiting the position of the glass substrate, ensuring a smooth completion of the cleaning process, reducing errors, and improving work efficiency.

If the size of the glass substrate changes, the first connecting rod 43 or the second connecting rod 44 can be moved in the axial direction of the conveying roller 2 according to the actual size of the glass substrate, thereby controlling the distance between the first connecting rod 43 or the second connection 44, so that the first first roller 41 and the second roller 42 are both located on the upper surface of the glass substrate, thereby cleaning the glass substrates with different dimensions, and improving cleaning efficiency and saving production cost.

In addition, in another embodiment, the present application further provides a system for cleaning glass substrate with different dimensions, which includes a control unit and the device for cleaning glass substrates with different dimensions. The device for cleaning glass substrates with different dimensions includes a rack 1, conveying rollers 2, a limiting assembly 4, a driving device 5, and a cleaning assembly 6.

The conveying rollers 2 are rotatably disposed on the rack 1 side by side, and at least one pair of adjacent conveying rollers are provided with a gap 3. The limiting assembly 4 includes a first roller 41 and a second roller 42 disposed oppositely, the first roller 41 is fixed on a first connecting rod 43, and the second roller 42 is fixed on a second connecting rod 44, and two ends of the first connecting rod 43 are respectively fixed on two opposite sides of the rack 1, two ends of the second connecting rod 44 are respectively fixed on two opposite sides of the rack 1, and the first connecting rod 43 and the second connecting rod 44 are movable along an axial direction of the conveying roller 2 so a glass substrate is positioned between the first roller 41 and the second roller 42 and the conveying roller 2.

The driving device 5 is configured to drive the conveying rollers 2, the first roller 41 and the second roller 42 to rotate, to enable the glass substrate move along a tangential direction of the rotating direction of the conveying roller 2. Rotating directions of the first roller 41 and the second roller 42 are opposite to the rotating direction of the conveying roller 2. The cleaning assembly 6 is disposed on the rack 1 and configured to clean the glass substrate.

The control unit is configured to control the operating states of the driving device 5 and the cleaning assembly 6. The connection relationships, the functions and the specific operating principles of the various structural components have been described in detail in the above embodiments, and are not reiterate herein.

What is mentioned above is only the specific implementation of the present application, but does not limit the protection scope of the present application, and anyone skilled in the art may easily think of mortifications or alternations within the technical scope disclosed by the present application, all of which should be contained within the protection scope of the present application. Therefore, the scope of the present application should be determined by the scope of the claims.

What is claimed is:

1. A device for cleaning glass substrates with different dimensions, comprising:

a rack;

conveying rollers, rotatably disposed on the rack side by side, at least one pair of adjacent conveying rollers being disposed with a gap;

a limiting assembly, comprising a first roller and a second roller disposed oppositely, the first roller being fixed on a first connecting rod, and the second roller being fixed on a second connecting rod, and two ends of the first connecting rod being respectively fixed on two opposite sides of the rack, two ends of the second connecting rod being respectively fixed on two opposite sides of the rack, and the first connecting rod and the second connecting rod being movable along an axial direction of the conveying roller, to enable the glass substrate to position between the first roller and the conveying rollers, and between the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly, disposed on the rack and configured to clean the glass substrates;

wherein the limiting assembly further comprises:

a first limit wheel located on the first connecting rod and driven by the driving device; and a second limit wheel located on the second connecting rod, the first limit wheel and the second limit wheel being both located in any one of the gaps, the first limit wheel is located on one side of the glass substrate, the second limit wheel is located on the other side of the glass substrate, and the glass substrate being located between the first limit wheel and the second limit wheel, and a tangential direction of a rotating direction of the first limit wheel, and a tangential direction of a rotating direction of the second limit wheel are same as a moving direction of the glass substrate.

2. The device for cleaning glass substrates with different dimensions according to claim 1, wherein the first limit wheel and the second limit wheel are truncated cone-shaped, and radii of the first limit wheel and the second limit wheel are gradually decreased.

3. The device for cleaning glass substrates with different dimensions according to claim 2, wherein each pair of conveying rollers defines one gap.

4. The device for cleaning glass substrates with different dimensions according to claim 3, wherein each gap is configured to receive at least one first limit wheel and at least one second limit wheel, and the gap ranges from 5 mm to 20 mm.

5. The device for cleaning glass substrates with different dimensions according to claim 4, wherein the gap has a size of 10 mm.

6. The device for cleaning glass substrates with different dimensions according to claim 4, wherein the gap has a size of 15 mm.

7. The device for cleaning glass substrates with different dimensions according to claim 1, wherein each pair of conveying rollers defines one gap.

8. The device for cleaning glass substrates with different dimensions according to claim 7, wherein at least one of the first limit wheel and at least one of the second limit wheel are disposed between each gap, the size of the gap ranges from 5 to 20 mm.

9. The device for cleaning glass substrates with different dimensions according to claim 1, wherein the limiting assembly comprises three pairs of first roller and second roller, the first rollers being evenly spaced, the second rollers being evenly spaced, and first rollers facing the second roller.

10. The device for cleaning glass substrates with different dimensions according to claim 9, wherein a first pair of the three pairs of first roller and second roller is disposed at one end of the rack, and a second pair of the three pairs of first roller and second roller is disposed at an intermediate position of the rack, and a third pair of the three pairs of first roller and second roller is disposed at the other end of the rack.

11. The device for cleaning glass substrates with different dimensions according to claim 1, wherein the limiting assembly comprises four pairs of first roller and second roller, the first rollers being evenly spaced, the second rollers being evenly spaced, and the first rollers facing the second rollers.

12. The device for cleaning glass substrates with different dimensions according to claim 1, wherein the cleaning assembly comprises:

an upper cleaning box located above the conveying roller and fixed to the rack by a fixing rod, the upper cleaning box comprising nozzles; and a lower cleaning box located below the conveying roller and fixed to the rack by another fixing rod, the lower cleaning box comprising nozzles.

13. The device for cleaning glass substrates with different dimensions according to claim 12, wherein:

the number of the upper cleaning boxes is two, the two upper cleaning boxes being evenly arranged directly above the conveying roller; and the number of the lower cleaning boxes is two, the two lower cleaning boxes being evenly arranged directly below the conveying roller.

14. The device for cleaning glass substrates with different dimensions according to claim 1, wherein the number of the conveying roller is two.

15. The device for cleaning glass substrates with different dimensions according to claim 1, wherein the number of the conveying roller is three.

16. The device for cleaning glass substrates with different dimensions according to claim 1, wherein rotation speeds of the conveying rollers are same as rotation speeds of the first roller and the second roller.

17. The device for cleaning glass substrates with different dimensions according to claim 16, wherein the cleaning assembly comprises:

an upper cleaning box located above the conveying roller and fixed to the rack by a fixing rod, the upper cleaning box comprising nozzles; and a lower cleaning box located below the conveying roller and fixed to the rack by another fixing rod, the lower cleaning box comprising nozzles.

18. A device for cleaning glass substrates with different dimensions, comprising:

a rack;

conveying rollers, rotatably disposed on the rack side by side, at least one pair of adjacent conveying rollers being disposed with a gap;

a limiting assembly, comprising a first roller and a second roller disposed oppositely, the first roller being fixed on a first connecting rod, and the second roller being fixed on a second connecting rod, and two ends of the first connecting rod being respectively fixed on two opposite sides of the rack, two ends of the second connecting rod being respectively fixed on two opposite sides of the rack, and the first connecting rod and the second connecting rod being movable along an axial direction of the conveying roller, to enable the glass substrate to position between the first roller and the conveying rollers, and between the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly, disposed on the rack and configured to clean the glass substrates;

wherein the limiting assembly further comprises a first limit wheel located on the first connecting rod and driven by the driving device and a second limit wheel located on the second connecting rod, the first limit wheel and the second limit wheel being both located in any one of the gaps, the glass substrate being located between the first limit wheel and the second limit wheel, and a tangential direction of a rotating direction of the first limit wheel, and a tangential direction of a rotating direction of the second limit wheel are same as a moving direction of the glass substrate;

the cleaning assembly comprises an upper cleaning box located above the conveying roller and fixed to the rack by a fixing rod and a lower cleaning box located below the conveying roller and fixed to the rack by another fixing rod, the upper cleaning box comprising nozzles, and the lower cleaning box comprising nozzles.

19. A system for cleaning glass substrates with different dimensions, comprising:

a control unit; and a device for cleaning glass substrates with different dimensions, comprising:

a rack;

conveying rollers, rotatably disposed on the rack side by side, at least one pair of adjacent conveying rollers being disposed with a gap;

a limiting assembly, comprising a first roller and a second roller disposed oppositely, the first roller being fixed on a first connecting rod, and the second roller being fixed on a second connecting rod, and two ends of the first connecting rod being respectively fixed on two opposite sides of the rack, two ends of the second connecting rod being respectively fixed on two opposite sides of the rack, and the first connecting rod and the second connecting rod being movable along an axial direction of the conveying roller, to enable the glass substrate to position between the first roller and the conveying rollers, and between the second roller and the conveying rollers;

a driving device, configured to drive the conveying rollers, the first roller and the second roller to rotate, to bring the glass substrate to move along a tangential direction of a rotating direction of the conveying roller, wherein rotating directions of the first roller and the second roller are opposite to the rotating direction of the conveying roller; and a cleaning assembly disposed on the rack and configured to clean the glass substrates;

wherein the control unit is configured to control operating states of the driving device and the cleaning assembly;

wherein the limiting assembly further comprises:

a first limit wheel located on the first connecting rod and driven by the driving device; and a second limit wheel located on the second connecting rod, the first limit wheel and the second limit wheel being both located in any one of the gaps, the glass substrate being located between the first limit wheel and the second limit wheel, and a tangential direction of a rotating direction of the first limit wheel, and a tangential direction of a rotating direction of the second limit wheel are same as a moving direction of the glass substrate.

* * * * *